United States Patent [19]

Krupenik et al.

[11] 4,139,135

[45] Feb. 13, 1979

[54] CONTINUOUS CASTING WITHDRAWAL APPARATUS

[76] Inventors: Vitaly N. Krupenik, ulitsa Darvina, 12, kv. 16; Vladimir I. Sosnenko, prospekt Moskovsky, 238a, kv. 15; Vladimir T. Sladkoshteev, ulitsa Dzerzhinskogo, 34, kv. 11; Oleg A. Shatagin, ulitsa Melnikova, 47, kv. 9, all of Kharkov; Anatoly I. Manokhin, 2 Schipovsky pereulok, 8, kv. 24, Moscow; Anatoly G. Sitnov, ulitsa Metallurgov, 80a, kv. 42, Tula; Vladimir N. Ordinartsev, ulitsa Stoletova, 5, kv. 1, Tula; Raisa P. Korotina, ulitsa Kutuzova, 138, kv. 6, Tula; Valery P. Druzhinin, ulitsa Martenovskaya, 5, kv. 10, Tula, all of U.S.S.R.

[21] Appl. No.: 754,437

[22] Filed: Dec. 27, 1976

[51] Int. Cl.[2] ..... B65H 17/36

[52] U.S. Cl. ..... 226/166; 226/167

[58] Field of Search ..... 226/158, 162, 165, 166, 226/167

[56] References Cited

U.S. PATENT DOCUMENTS

| | | | |
|---|---|---|---|
| 2,728,447 | 12/1955 | Ware | 226/166 X |
| 2,840,381 | 6/1958 | Mersek | 226/166 X |

*Primary Examiner*—Richard A. Schacher

*Attorney, Agent, or Firm*—Lackenbach, Lilling & Siegel

[57] ABSTRACT

The withdrawal apparatus comprises a housing through which a cast ingot passes, said housing being mounted for reciprocating movement and for travelling in the direction along which the cast ingot is withdrawn and then back to its initial position. Mounted in the housing are shoes and wedge blocks with rollers arranged therebetween, said rollers being locked into position between the shoes and wedge as the housing travels in the direction of withdrawal of said cast section. The shoes are associated with a rod fitted with a compression spring bearing up against the housing and producing a force acting in the direction opposite to the movement of the housing during the withdrawal operation. When the withdrawal cycle is over, the shoes being spring-biased, release or unlock the rollers.

5 Claims, 2 Drawing Figures

CONTINUOUS CASTING WITHDRAWAL APPARATUS

FIELD OF THE INVENTION

The present invention relates to continuous casting machines and, more particularly to withdrawal apparatus for pulling a casting from a mold.

DESCRIPTION OF THE PRIOR ART

Broadly applicable to adaptation in the continuously casting process of metals are withdrawal apparatus which incorporate driven and gripping rolls, and those based on the so-called "locking-up" principle, which is that the withdrawal apparatus travels in one direction while pulling a casting and slides along the casting back to its initial position. The withdrawal-roll apparatus suffer from a disadvantage, it being the slipping of the driven rolls along the cast piece. With an increase in the pressure force of the rolls, the contact pressure on the casting surface damages the quality of the casting.

The withdrawal apparatus of the locking-up type usually comprise a housing with shoes and wedge elements in the form of rollers and wedge blocks mounted therein.

The housing of this type of apparatus is mounted for reciprocating movement and driven by a driving mechanism. During forward movement of the withdrawal apparatus, the rollers and the wedge blocks are actuated to lock the shoes into position thus pressing them against the casting. Said shoes are released or unlocked as the apparatus slides along the cast piece back to its initial position.

It is to be noted that both types of the aforedescribed withdrawal apparatus suffer from a common disadvantage which is that the pressing or gripping means, which engage the cast piece, are fixed or locked into position so rigidly, that their unlocking is effected an inadequate speed of response relative to the initial moment of the apparatus return travel, which impairs the stability of the withdrawal process.

Moreover, the withdrawal operation is impossible to carry on in the event of bulgings occurring on the casting surface, the reason for this being a fixed clearance between the shoes and the casting surface.

SUMMARY OF THE INVENTION

It is an object of the present invention to provide for stability of the continuous casting process and improved quality of the cast ingot.

Another object of the invention is to provide a continuous casting withdrawal apparatus which will allow the unlocking operation to be substantially in step with the initial moment of the apparatus return travel.

These and other objects of the invention are attained in a withdrawal apparatus for pulling a casting from a mold, comprising a housing mounted for reciprocating movement and capable of travelling along the axis of the casting in the direction of the withdrawal movement and back to its initial position, said housing having mounting therein shoes, having a shape corresponding to the casting profile, wedge blocks and rollers. The rollers are arranged between the shoes and the wedge blocks so as to be locked into position therebetween, thus pressing the shoes against the casting surface during the housing travel in the direction of the casting withdrawal, said rollers being released or unlocked on the housing's return travel. The shoes, according to the invention, are connected with the housing through a spring means producing a force acting along the axis of the casting in the direction opposite to the casting withdrawal movement.

The advantage of the herein proposed withdrawal apparatus is that, due to the shoes being spring-biased relative to the apparatus housing and capable of longitudinal movement therealong, the unlocking of said shoes is effected with an adequate speed of response relative to the initial moment of the apparatus return travel. Thereby, the process of withdrawing a casting is rendered stable and the quality of the casting is improved.

It is desirable that the springs be mounted so that the compression stress thereof is readily adjustable over a range of various sizes to be cast.

BRIEF DESCRIPTION OF THE DRAWINGS

Additional objects and features of the invention will appear from the following description in which the preferred embodiment is set forth in detail in conjunction with accompanying drawings. Referring to the drawings.

DETAILED DESCRIPTION OF THE INVENTION

Figure 1:
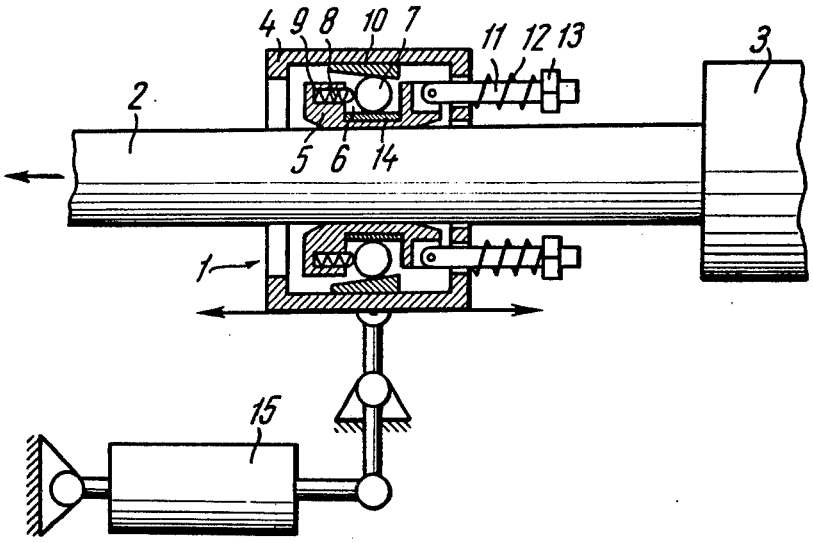
FIG. 1 is a longitudinal view of a withdrawal apparatus for pulling a casting, according to the invention.

In FIG. 1 there is shown a withdrawal apparatus 1 in the process of pulling out a casting, said apparatus being mounted on a casting 2.

The casting of this type can be readily formed in any conventional mold 3, the design of which is well known to those skilled in the art. Water-cooled molds with a dummy bar are preferable for use.

Figure 2:
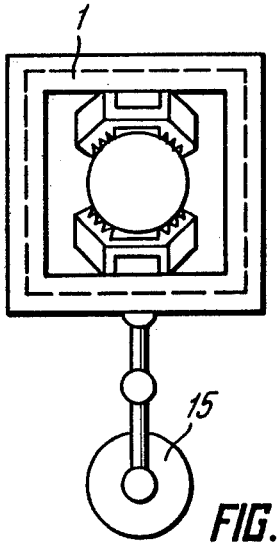
FIG. 2 is an end view of the same apparatus as viewed from the casting discharge side.

FIG. 2 shows the withdrawal apparatus for pulling the casting 2 at the moment when the shoes 5 are pressed against said casting.

The herein proposed withdrawal apparatus 1 (FIG. 1) for extracting a casting 2 from a mold 3 comprises a housing 4 having mounting therein shoes 5 facing said casting and externally shaped so as to correspond to the profile of the casting 2, which makes for an uniform distribution of the pressure or grip force over said casting and thus prevents deformation thereof. The surface of the shoes 5 facing, and in contact with, the casting 2 is made rough by any possible means, as by notching thereof, to ensure intimate mating of the contacting surfaces of the shoes 5 and the casting 2. This also prevents the shoes 5 of the apparatus I from slipping over the casting 2 during the withdrawal cycle. The shoes 5 are usually made of refractory and wear-resistant materials, such as refractory steel or metal ceramics. The shoes 5 are formed with grooves 6 having rollers 7 mounted therein.

It is advisable that the shoes 5 be formed with bores 8 in (or facing) the interior surface of the grooves 6 that is oriented in the withdrawal direction of the casting 2 and at the level of the axis of the rollers 7, said bores being intended for mounting a spring 9 having one end thrust against the bottom portion of the bore 8 and the other end thrust against the roller 7. This spring arrangement enables fast locking of the shoes 5.

Mounted in the housing 1 above the grooves 6 of the shoes 5 are wedge blocks 10 rigidly fixed to said housing and inclined in the direction of the withdrawal of the casting 2.

Pivoted on the shoes 5 are rods 11 on which are mounted compression springs 12. It is preferable to use a helical spring made of any elastic material. The spring 12 is fitted onto the rods 11 so that one end of said spring is thrust against the housing 4 and the other end is fixed the rod, 11 as shown in FIG. 1. It is also desirable that the compression stress of the spring 12 fitted onto the rod 11 be adjustable over a range of various sizes to be cast. The compression stress of the spring 12 may be adjusted by means of an adjusting screw 13 fitted on the end of the rod 11 and against which the other end of the spring 12 is thrust.

It has been experimentally found that the compression stress of the spring is approximately equal to one tenth of the pressure force of the shoes applied to the cast section. For example, if the pressure force of the shoes 5 applied to the casting 2 is 2 tons, the compression stress of the spring 12 will be in the range from 150 to 250 kg. Hydraulic or air cylinders may be readily used instead of the spring.

It is preferable that adjacent plates 14 be arranged in the interspace between the shoes 5 and the rollers 7, said plates preventing the shoes 5 from deforming. The withdrawal apparatus 1 is actuated by a driving mechanism 15. Any driving mechanism shich is adapted to ensure reciprocating motion, e.g. a hydraulic cylinder, may be used for the purpose.

The herein proposed apparatus operates as follows.

The apparatus 1 is urged by the driving mechanism 15 in the direction of the casting withdrawal, thereby actuating the rollers 7 which by rolling on the wedge blocks 10, lock into position the shoes 5, the shoes 5 now being pressed against the casting 2 with a force sufficient to effect its withdrawal from the mold 3.

When said apparatus reaches its extreme position, there commences the withdrawal cycle during which the casting 2 is extracted over a prescribed range of size. Thereafter, the apparatus 1 is driven by the driving mechanism 15 back to its initial position. During the apparatus return travel the casting 2 is at rest. At the moment when the apparatus 1 is set to its return movement, the spring 12 is compressed and is tending toward non-compression. As this happens the spring 12 is thrust against the housing 4 and acts through the rod 11 on the shoe 5 urging it in the direction opposite to that in which the housing 4 is moving.

As a result of this, the roller 7 rolls away from the wedge block 10, thus releasing the shoes 5 from pressure. The shoes 5 are brought away from the casting 2 and the apparatus 1 is returned to its initial position. Then the cycle resumes.

In case of buckling occurring on the surface of the cast section, the shoe 5 is moved in the direction of the casting withdrawal, the spring 12 is compressed and the clearance between the shoe 5 and the casting surface is increased. In this case the shoe 5 grips the buckling portion of the cast piece while the housing 4 is moving towards the mold 3. The buckling portion having been passed, the clearance between the shoe 5 and the casting 2 decreases.

What is claimed is:

1. A continuous casting withdrawal apparatus, comprising: a housing formed with openings in its walls through which a casting being withdrawn passes, said housing being mounted for reciprocating movement along the axis of said casting in the direction of its withdrawal and then back to its initial position; shoes mounted within said housing and movable along the axis of the casting, said shoes being externally shaped so as to correspond to the casting profile; wedge blocks mounted within said housing and off-set from the shoes in a direction away from the axis of the casting withdrawal, said wedge blocks being inclined in said direction of withdrawal; rollers arranged in an interspace between said shoes and wedge blocks, said rollers being locked into position between said shoes and wedge blocks when the housing travels in the direction of the casting withdrawal, said rollers being unlocked on the housing's return travel to said initial position; a spring means to connect said shoes with the housing producing a force acting along the axis of the casting and in a direction opposite to the casting's withdrawal movement; and a driving means for moving the housing in the direction of the casting withdrawal and then back to said initial position.

2. A withdrawal apparatus as claimed in claim 1, wherein the spring means incorporates a rod arranged parallel to the axis of the mold and coincident with the center line of the rollers, said rod being affixed on one of said shoes and carrying the spring which is thrust with one end against the housing and which is fixed with the other end on the rod.

3. A withdrawal apparatus as claimed in claim 2, wherein said spring is mounted so that its compression stress is readily adjustable.

4. A withdrawal apparatus as claimed in claim 1, wherein said shoes have a bore; and further comprising a second spring positioned in said bore and having one end thrust against a bottom of said bore and another end thrust against said roller.

5. A withdrawal apparatus as claimed in claim 2, wherein said shoes have a bore; and further comprising a second spring positioned in said bore and having one end thrust against a bottom of said bore and another end thrust against said roller.

* * * * *